United States Patent [19]

Urakami

[11] Patent Number: 4,934,475

[45] Date of Patent: Jun. 19, 1990

[54] DEVICE CAPABLE OF SUCTION-ADHERING TO A WALL SURFACE AND MOVING THEREALONG

[76] Inventor: Fukashi Urakami, 5-21-204 Konandai 4-chome, Konan-ku, Yokohama, Japan

[21] Appl. No.: 171,123

[22] Filed: Mar. 21, 1988

[30] Foreign Application Priority Data

| | | | |
|---|---|---|---|
| Apr. 4, 1987 | [JP] | Japan | 62-83431 |
| Apr. 27, 1987 | [JP] | Japan | 62-103744 |
| Jun. 1, 1987 | [JP] | Japan | 62-137887 |
| Mar. 3, 1988 | [JP] | Japan | 63-04683 |

[51] Int. Cl.[5] ..... B24C 3/06; B24B 23/00

[52] U.S. Cl. ..... 180/164; 51/429; 51/180; 114/222; 15/52; 15/98

[58] Field of Search ..... 51/429, 174, 175, 170 TL, 51/273, 180; 180/164; 114/222; 15/52, 98, 49 C

[56] References Cited

U.S. PATENT DOCUMENTS

| | | | |
|---|---|---|---|
| 2,766,557 | 10/1956 | Polland | 51/429 |
| 4,095,378 | 6/1978 | Urakami et al. | 51/429 |
| 4,688,289 | 8/1987 | Urakami | 114/222 |

FOREIGN PATENT DOCUMENTS

| | | | |
|---|---|---|---|
| 0154262 | 11/1953 | Australia | 180/164 |

*Primary Examiner*—Robert Rose

*Attorney, Agent, or Firm*—Beveridge, DeGrandi & Weilacher

[57] ABSTRACT

A device comprising a main body and vibration generating means mounted on the main body. The vibration generating means imparts a force in a direction away from a wall surface and a force in a predetermined direction along the wall surface to the main body of the device. As a result, the main body is moved along the wall surface by the above force in the predetermined direction along the wall surface.

18 Claims, 5 Drawing Sheets

DEVICE CAPABLE OF SUCTION-ADHERING TO A WALL SURFACE AND MOVING THEREALONG

FIELD OF THE INVENTION

This invention relates to a device capable of suction-adhering to an inclined wall surface or the like and moving therealong.

DESCRIPTION OF THE PRIOR ART

A device capable of suction-adhering to an inclined or substantially perpendicular wall surface in ships, buildings, etc. and moving therealong is disclosed, for example, in U.S. Pat. No. 4,095,378. Such a device comprises a main body which undergoes the action of an ambient fluid pressure, a seal wall mounted on the main body, vacuum creating means for evacuating a reduced pressure space defined by the main body, the seal wall and a wall surface, and travelling means mounted on the main body. When the vacuum creating means is energized in this device, the pressure reduction space is reduced in pressure, and the main body of the device is caused to adhere to a wall surface by the pressure of the ambient fluid which acts on the main body owing to a difference in fluid pressure between the inside and outside of the pressure reduction space. When the travelling means is energized while the main body is adhering to the wall surface, it is moved along the wall surface. In the conventional device of this type, the travelling means is comprised of a wheel (a driving wheel to be rotated or a combination of such a driving wheel and a follower wheel to be driven), or an endless track. Hence, the travelling means is complex and large-sized, and the entire device becomes complex and large-sized and requires a higher cost of building. Since the entire device increases in size, vacuum creating means of greater ability should be used. This also adds to the cost of building. Moreover, if the entire device increases in size, it fails to suction-adhere to a wall surface of a large curvature, and the range of its use is restricted inconveniently.

SUMMARY OF THE INVENTION

It is a primary object of this invention to provide an excellent device which can suction-adhere to a wall surface and move therealong with a simple structure.

Another object of this invention is to provide an excellent device which is smaller in size and lower in the cost of building than in the prior art.

According to this invention, there is provided a device comprising a main body and vibration generating means mounted on the main body, said vibration generating means being adapted to impart a force in a direction away from a wall surface and a force in a predetermined direction along the wall surface to the main body by the vibration it generates, and consequently to move the main body in said predetermined direction along the wall surface.

DETAILED DESCRIPTION OF PREFERRED EMBODIMENTS

The invention will be described in detail with reference to the accompanying drawings.

First Embodiment

Figure 1:
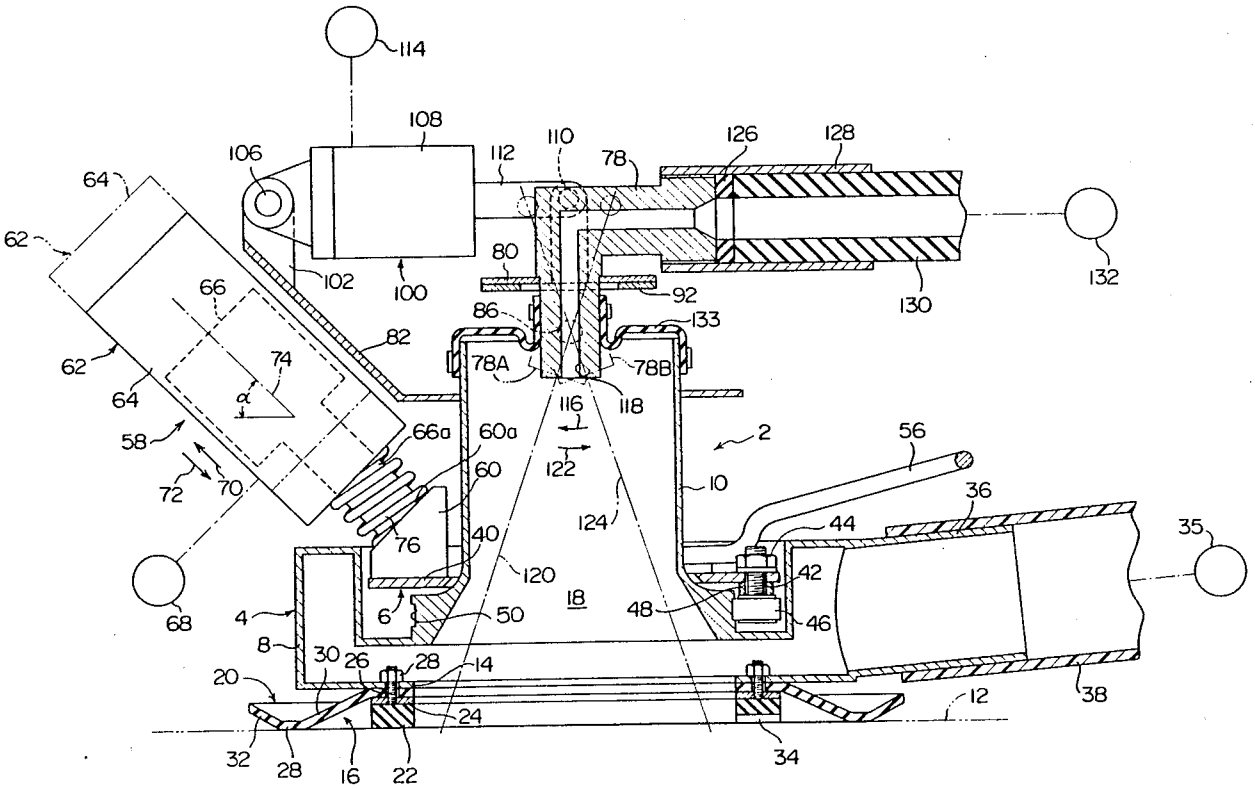
FIG. 1 is a sectional view showing a first embodiment of the device constructed in accordance with this invention.
Figure 2:
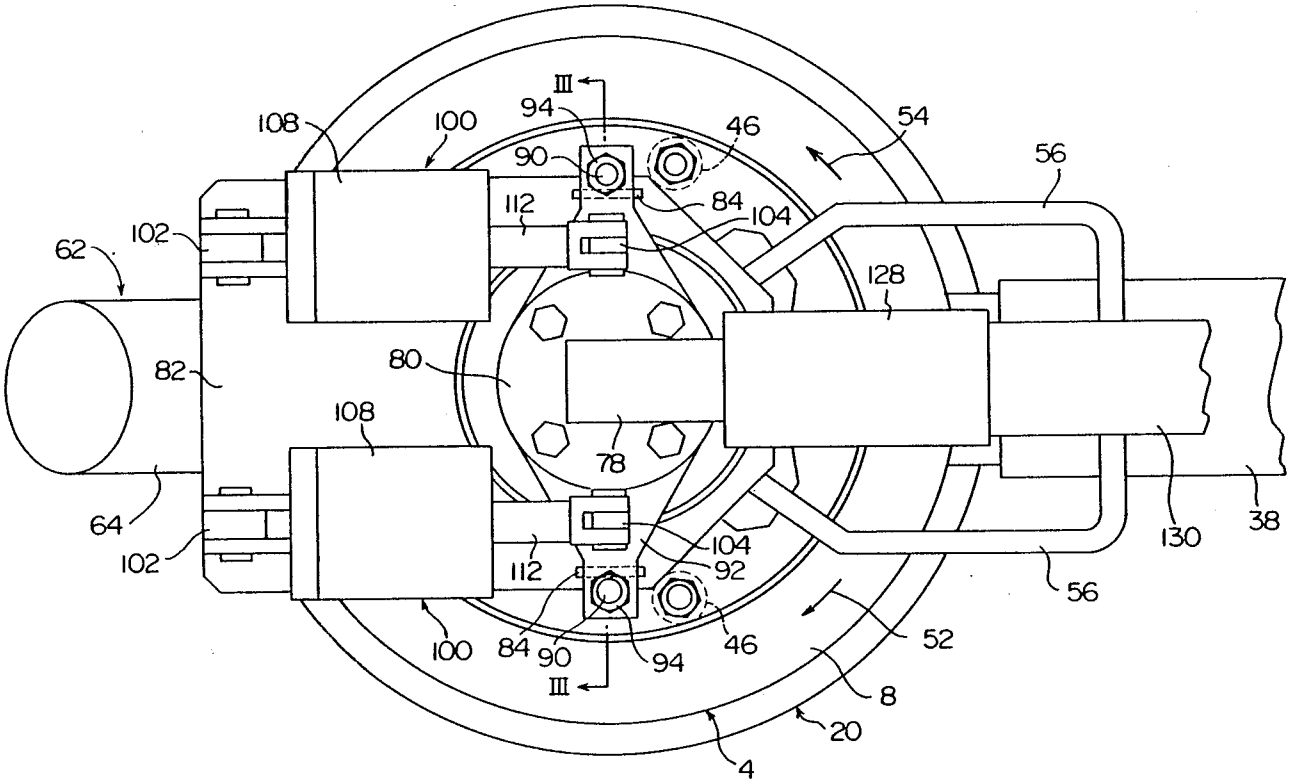
FIG. 2 is a top plan view of the device shown in FIG. 1.
Figure 3:
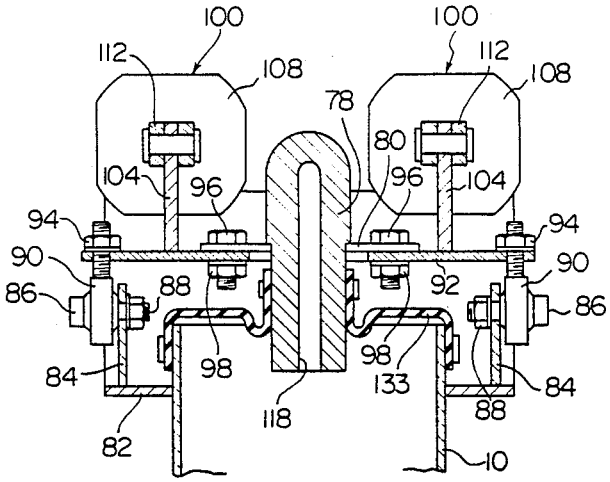
FIG. 3 is a sectional view taken along line III—III of FIG. 2.

With reference to FIGS. 1 to 3, the first embodiment of the invention will be described.

In FIGS. 1 and 2, the illustrated embodiment has a main body shown generally at 2. The main body 2 is comprised of a main body portion 4 and a rotary securing portion 6 secured to the main body portion 4 in such a manner as to be free to rotate relative to the main body portion 4. The main body portion 4 has a short cylindrical lower portion 8 and an upper portion 10 projecting cylindrically from nearly the central part of the upper surface of the lower portion 8. The lower portion 8 and the upper portion 10 define a space through which they communicate with each other. A nearly circular opening 14 is formed in the under surface in FIG. 1 of the lower portion (that surface which faces a wall surface 12 when the device is in operation). A seal member 16 is disposed in the opening 14 of the lower portion 8. The seal member 16 has an annular seal portion 20 defining a pressure reduction space 18 to be described and a receiving portion 22 for receiving the main body 2 of the device. A plurality of circumferentially spaced holes are formed in the inside edge part of the seal portion 20, and a plurality of circumferentially spaced holes are also formed in the opening 14 of the lower portion 8. An annular securing plate 24 is provided for fixing the seal porton 20, and a plurality of threaded rods 26 are fixed to the securing plate 24 by such means as welding. As shown in FIG. 1, each of the threaded rods 26 passes through the hole of the seal portion 20 and the hole of the lower portion 8, and projects inwardly thereof, and a fixing nut 28 is applied to the projecting end portion, whereby the inside edge part of the seal portion 20 is fixed between the annular securing plate 24 and the opening portion of the lower portion 8. Preferably, as shown in FIG. 1, the seal portion 20 is provided with a main portion 30 extending from its one end connected to the lower portion 8 outwardly toward a contact portion 28 to come into contact with the wall surface 12 in a direction approaching the wall surface 12 and an extension 32 extending from the contact portion 28 outwardly toward the other end in a direction away from the wall surface 12. Because of this arrangement, the seal portion 20 can easily ride over protrusions which may exist on the wall surface 12. As can be seen from FIG. 1, the seal portion 20 in the seal member 16 defines the pressure reduction space 18 in cooperation with the main body portion 4 (the lower portion 4 and an upper portion 6) of the main body 2 and the wall surface 12. The receiving portion 22 of the seal member 20 is comprised of an annular member, and fixed to the under surface of the securing plate 24 by such means as the use of an adhesive. The receiving portion 22, as will be described hereinafter, acts to transmit the pressure of an ambient fluid acting on the main body 2 of the device to the wall surface. The seal portion 20 and the receiving portion 22 may be formed of synthetic rubber such as polyurethane rubber. In the illustrated embodiment, the seal portion 20 and the receiving portion 22 in the seal member 16 are formed separately. If desired, however, they may be formed as a one-piece unit. In the illustrated embodiment, the main body 2 of the device is received by the receiving portion 22. If desired, the receiving portion 22 may be omitted, and the main body 2 may be received by the seal portion 20. When the main body 2 is to be received by the receiving portion 22 as in the illustrated embodiment, it is preferred to provide communication channels 34 permitting communication between a space defined between the seal portion 20 and the receiving portion 22 and a space defined inwardly of the receiving portion 22 (for example, a plurality of such communicating channels may be provided in spaced-apart relationship at that part of the receiving portion 22 which is to make contact with the wall surface 12). This structure enables the pressure in the pressure reduction space 18 to act on the seal portion 20 via the communication channels 34. The shape of the sealing member 16 is not limited to the one described above, and it may be of any other shape in which the seal member 16 defines the pressure reduction space 18 in cooperation with the main body 2 and the wall surface 12. The seal member 16 may be formed of a brush or the like.

The pressure reduction space 18 is connected to vacuum creating means 35 such as a vacuum pump. In the illustrated embodiment, a connecting portion 36 is formed integrally in the side wall of the lower portion 8, and one end of a flexible hose 38 is connected to the connecting portion 36. Its other end portion communicates with the vacuum creating means 35. Accordingly, upon energization of the vacuum creating means 35, a fluid in the pressure reduction space 18 is discharged outside through the connecting portion 36 and the hose 38, and the pressure reduction space 18 is reduced in pressure as is desired.

The rotary securing portion 6 is mounted on the main body portion 4 in the following manner. The rotary securing portion 6 in the illustrated embodiment is comprised of an annular plate 40, and as shown in FIG. 1, the upper portion 10 of the main body portion 4 projects upwardly through a circular opening defined in the annular plate 40. A plurality of (five in the illustrated embodiment) circumferentially spaced holes (one of which is shown in FIG. 1) are formed in the annular plate 40, and a threaded rod 42 is fitted into each of the holes by means of a bolt 44. A roller 46 is rotatably mounted on one end portion of each threaded rod 42, and a hollow cylindrical spacer 48 fitted over the intermediate part of the threaded rods 42 is interposed between one end portion of each threaded rod 42 and the annular plate 40. The spacer 48 maintains the distance between the annular plate 40 and the roller 46 at a predetermined value. A guide channel 50 is defined entirely on the peripheral surface of the lower end portion of the upper portion 10, and the rollers 46 are movably received in the guide channel 50. Thus, when the rotary securing portion 6 is rotated in the direction shown by an arrow 52 (or 54) relative to the main body portion 4, each roller 46 moves along the guide channel 50 while rolling to permit smooth rotation of the rotary securing portion 6 relative to the main body portion 4.

An operating handle 56 for rotating the rotary securing portion 6 is provided in the annular plate 40. The operating handle 56 is formed of a nearly U-shaped material and its both end portions are fixed to the annular plate 40 by welding or otherwise.

Vibration generating means 58 is also secured to the annular plate 40 in order to impart a moving force to the main body 2 of the device. A block piece 60 is fixed by welding or otherwise to that site of the annular plate 40 which is opposite to the site at which the operating handle 56 is disposed. A cylinder mechanism 62, such as a pneumatic cylinder mechanism, which constitutes the vibration generating means is mounted on the block piece 60. The cylinder mechanism 62 is comprised of a housing 64 and a piston 66 disposed movably within the housing 64. A rod portion **66*a* of the piston 66, which projects through the cylinder housing 64, is secured to the block piece 60. As shown in FIG. 1, the securing surface 60*a* of the block piece 60 is inclined, and therefore, the cylinder mechanism 62 secured to the securing surface 60*a* extends at an inclination angle $\alpha$ to the wall surface 12 to which the main body 2 of the device suction-adheres. The inclination angle $\alpha$ may be about 30 to 70 degrees, and in the illustrated embodiment, it is substantially 45 degrees. It will be easily understood from the description given hereinafter that if the inclination angle $\alpha$ is increased, the force in a direction away from the wall surface 12 which is to be applied to the main body 2 of the device increases, and therefore in order to fully overcome the suction-adhering force of the main body 2 with respect to the wall surface 12, it is preferred to make the inclination angle $\alpha$ greater. On the other hand, if the inclination angle $\alpha$ is decreased, the force in a direction along the wall surface 12 which is to be applied to the main body 2** of the device increases, and therefore, in order to fully obtain the moving force in the moving direction, it is preferred to set this inclination angle $\alpha$ at a relatively small value.

The cylinder mechanism 62 is connected to a pressure fluid supply source 68 such as a compressor. When a pressure fluid such as compressed air is supplied from the pressure fluid supply source 68, the cylinder mechanism 62 is stretched and contracted, and the cylinder housing 64 is moved in the direction shown by an arrow 70 or 72 relative to the piston 66 fixed to the block piece 60. The cylinder housing 64 moves from the contracted position shown by a solid line in FIG. 1 to a stretched portion shown by a two-dot chain line in FIG. 1 in the direction of arrow 70 and comes into collision with the piston 66 to generate a vibration. The vibration, in turn, produces a force tending to move the main body 2 along the wall surface 12. Specifically, when the cylinder housing 64 moves in the direction of arrow 70 and collides with the piston 66, a force tending outwardly of an axis 74 (FIG. 1) is generated in the cylinder mechanism 62, and acts on the main body 2 of the device. It will be understood from FIG. 1 that the force so exerted can be divided into a force in a direction away from the wall surface 12 (the force substantially perpendicular to the wall surface 12( and a force in a direction along the wall surface 12 (the force substantially parallel the wall surface). The force in a direction away from the wall surface 12 acts to move the main body 2 away from the wall surface against the suction-adhering force of the main body 2 to the wall surface 12. The force in a direction along the wall surface 12 acts to move the main body 2 along the wall surface 12.

In the illustrated embodiment, a compression coil spring 76 constituting biasing means is interposed between the securing surface **60*a* of the securing block piece 60 and the cylinder housing 64 of the cylinder mechanism 62 so as to fit over the rod 66***a*. The compression coil spring 76 always biases the cylinder housing 64 elastically in the direction of arrow 70 to increase the moving speed of the cylinder housing 64 in the direction of arrow 70. Thus, the impact which occurs upon collision of the cylinder housing 64 with the piston 66 increases and the above-mentioned force is amplified. A piston vibrator sold as Model NTK25 by Netter Company, West Germany, for example, may be used as the cylinder mechanism 62. If desired, instead of the cylinder mechanism 62, various known vibration generating means, such as electromagnetically operable means, may be used as the vibration generating means 58.

In the illustrated embodiment, the inside part of the lower portion 4 is made lower than its outside part, and the annular plate 40 and the rollers 46 are arranged in an annular space existing between the outside part and the lower part of the upper portion 10. Hence, the center of gravity of the main body 2 can be lowered by causing the cylinder mechanism 62 to considerably approach the wall surface 12, and the tumbling of the device can be prevented.

The device in the illustrated embodiment further includes treating means for treating the wall surface 12 in a required manner. With reference also to FIG. 3, the illustrated treating means is provided with a nozzle 78 disposed in the open upper end of the upper portion 10. The nozzle 78 is nearly L-shaped, and to its one end portion is fixed a fixing flange 80 by welding or other means. On the other hand, a supporting plate 82 is fixed to the upper end portion of the upper portion 10 by welding or otherwise. A pair of projecting supporting pieces 84 projecting upwardly are fixed to the upper surface of the supporting plate 82. A rod member 90 having an external thread formed at one end portion is rotatably linked to the upper end portion of each projecting supporting piece 84 via a bolt 86 and a nut 88. One end portion of the rod member 90 projects through a hole formed in a swing plate 92, and by applying a nut 94 to the projecting portion of each rod member 90, the swing plate 92 is mounted across the pair of rod members 90. A hole is formed nearly centrally in the swing plate 92. The nozzle 78 is secured to the swing plate 92 by positioning one end portion of the nozzle 78 in the hole of the swing plate 92 and attaching its flange 80 to the inside edge portion of the swing plate 92 by means of a bolt 96 and a nut 98. In the illustrated embodiment, cylinder mechanisms 100 such as pneumatic cylinder mechanisms are interposed between the swing plate 92 and the supporting plate 82. Part of the supporting plate 82 extends in an inclined manner outwardly and upwardly, and a pair of linking pieces 102 are fixed to its inclined upper end portion. A pair of spaced linking pieces 104 are also fixed to the upper surface of the swing plate 92, and cylinders 108 of the cylinder mechanisms 100 are linked pivotally to the linking pieces respectively via pins 106, and output rods 112 of the cylinder mechanisms 100 are respectively linked pivotally to the linking pieces 104 via pins 110. The cylinder mechanisms 100 are connected to a pressure fluid supply sources 114 such as compressors and stretched and contracted by a pressure fluid such as compressed air from the pressure fluid supply source 114. When the cylinder mechanisms 100 are stretched, the nozzle 78, the swing plate 92 and the pair of rod members 90 pivot in the direction shown by an arrow 116 (FIG. 1) about the bolt 86 as a center. Accordingly, an impinging port 118 formed in the nozzle 78 points to the direction shown by a one-dot chain line 120 in FIG. 1. When the cylinder mechanisms 100 are contracted, the nozzle 78 and the swing plate 92 likewise pivot in the direction shown by an arrow 122 about the bolt 86 as a center, and the impinging port 118 of the nozzle 78 points to the direction shown by a one-dot chain line 124. The other end portion of the nozzle 78 is connected to a hose 130 formed of, for example, a synthetic rubber by a packing 126 and a nozzle holder 128. The hose 130 is connected to a treating material supply source 132 for supplying a surface treating material such as high-pressure water. A flexible rubber cover 133 is disposed in the upper open end of the upper portion 10, and its one end portion is attached to the upper end of the upper portion 10. The other end portion of the rubber cover 133 is attached to one end portion of the nozzle 78. The cover 133 covers the upper open surface of the upper portion 10 of the main body and hampers intrusion of the fluid from the open upper surface. Hence, the surface treating material from the treating material supply source 132 passes through the hose 130 and is impinged against the wall surface 12 from the impinging port 118 of the nozzle 78, and by the stretching and contraction of the cylinder mechanisms 100, the surface treating material is applied to an area between the one-dot chain lines 120 and 124. Instead of high-pressure water, such a treating material as an abrasive material or a cleaning material (optionally together with compressed air) may be ejected from the nozzle 78.

The operation and effect of the device of the first embodiment above will now be described.

Mainly with reference to FIG. 1, when the vacuum creating means 35 is energized, a fluid such as air in the pressure reduction space 18 is discharged outside through the hose 38, and the pressure reduction space 18 is reduced in pressure. As a result, owing to the difference in fluid pressure between the inside and outside of the pressure reduction space 18, an ambient fluid pressure such as atmospheric pressure acts on the main body portion 4 of the main body 2 of the device, and the main body 2 suction-adheres to the wall surface 12. As can be seen from FIG. 1, in this suction-adhering state, the force acting on the main body 2 of the device is transmitted to the wall surface 12 mainly via the annular receiving portion 22 of the seal member 16. Furthermore, the fluid pressure acting on the seal portion 20 of the seal member 16 owing to the difference in fluid pressure between the inside and outside of the pressure reduction space 18 is transmitted to the wall surface 12 via the contacting portion 28 of the seal portion 20. Consequently, a seal is maintained between the seal portion 20 and the wall surface 12 by the fluid pressure.

When the pressure fluid supply source 68 is energized in the above suction-adhering state, the cylinder mechanism 62 is stretched and contracted by the action of a pressure fluid such as compressed air from the pressure fluid supply source 68. As a result, by the impact generated every time the cylinder mechanism 62 stretches, a vibration tending to move the main body 2 of the device acts on the main body 2, and the device moves while suction-adhering to the wall surface 12. When the cylinder housing 64 moves in the direction of arrow 70 and comes into collision with the piston 66, the impact force generates a force lifting in a direction away from the wall surface 12 and a moving force in a direction along the wall surface 12 in the rotary securing portion 6. These forces are transmitted to the main body portion 4 via the bolts 44 and the rollers 46. The force in the direction away from the wall surface 12 weakens the suction-adhering force of the main body 2, and the force in the direction along the wall surface 12 imparts a moving force to the main body 2. Consequently, the device suction-adhering to the wall surface 12 is moved in a direction in which the cylinder mechanism 62 is inclined upwardly by the impact force generated at the time of collision, i.e. to the left in FIG. 1. The force in the direction away from the wall surface 12 and the force in the direction along the wall surface 12 which are imparted by the cylinder mechanism 62 act simultaneously at the time of collision of the cylinder housing 64 and the piston 66. Accordingly, when the force in the direction away from the wall surface 12 acts to weaken the frictional force between the receiving portion 22 of the seal member 6 and the wall surface 12, the force in the direction along the wall surface 12 acts to perform the above movement of the device effectively. Even when the main body 2 of the device (particularly, the receiving portion 22) separates from the wall surface 12 by the force in the direction away from the wall surface 12 at the time of collision, the seal portion 20 of the seal member 16 is further elastically deformed toward the wall surface 12 owing to the difference in fluid pressure between the inside and outside of the pressure reduction space 18. Hence, the seal between the contacting portion 28 of the seal portion 20 and the wall surface 12 is never broken.

When the treating material supply source 132 is energized, a treating material such as high-pressure water passes through the hose 130 and is impinged against the wall surface 12 from the nozzle 78. As a result, foreign materials such as rust and degraded paint existing on the wall surface 12 can be removed by the high-pressure water from the nozzle 78. The removed foreign material are preferably collected by a dust collector or the like connected to the vacuum creating means 35. By impinging the treating material while the main body 2 of the device is adhering to, and moving along, the wall surface 12, the substantially entire area of the wall surface 12 can be treated as is required.

When the pressure fluid supply source 114 is energized to stretch or contract the cylinder mechanisms 100 during impinging of the treating material, the nozzle 78 revolves about the bolt 86 as a center between an angular position shown by a two-dot chain line 78A in FIG. 1 and an angular position shown by a two-dot chain line 78B, and the treating material is impinged against the area between the two-dot chain lines 120 land 124. As a result, the treating material is impinged over a broad range and the surface treating job can be carried out with good efficiency.

The travelling direction of the device may be changed by operating the operating handle 56 and rotates the rotary securing portion 6 in the direction of arrow 52 or 54 (FIG. 2) with respect to the main body portion 4. As a result, the position of the cylinder mechanism 62 to the main body portion 4 changes and the main body 2 moves in the inclined direction of the displaced cylinder mechanism 62.

In the first embodiment, the rotary securing portion is rotated with respect to the main body portion 4 by the operator's manipulation of the operating handle 56. Alternatively, it is possible to change the travelling direction of the main body 2 of the device by the action of a driving source as shown in FIG. 4.

Figure 4:
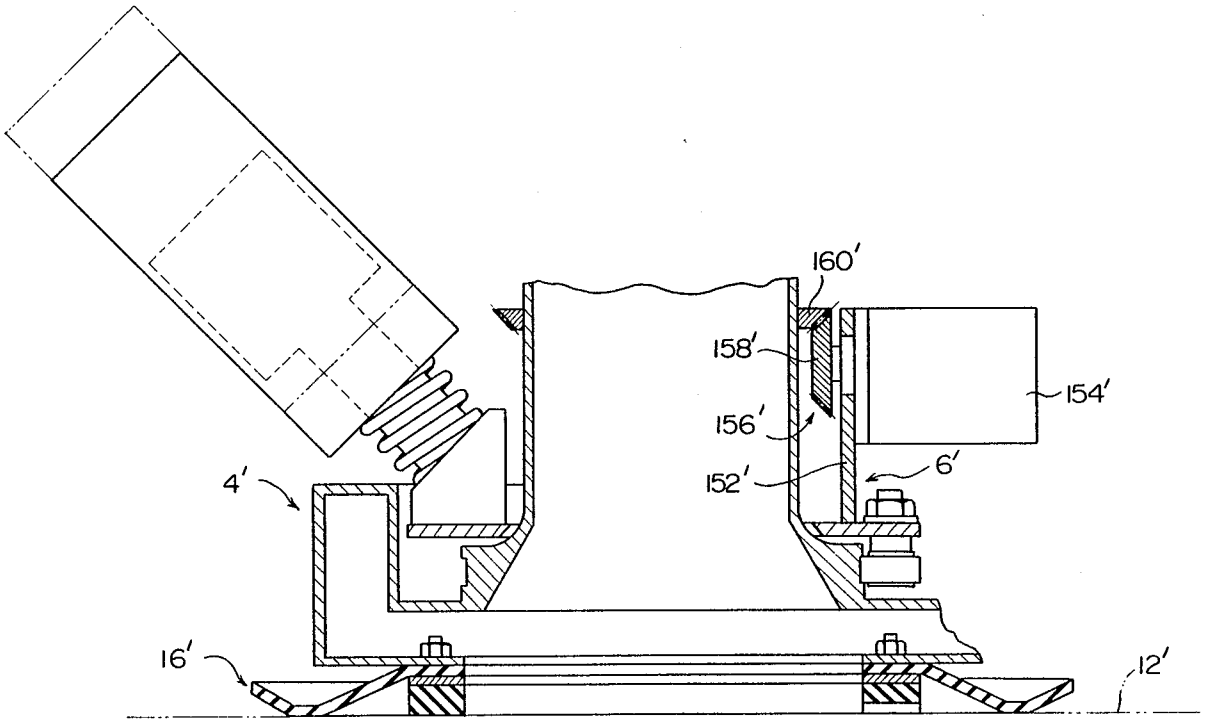
FIG. 4 is a sectional view showing the principal parts of a modification of the device of FIG. 1.

In FIG. 4, a supporting plate 151' instead of the operating handle is mounted on the rotary securing portion 6', and an electric motor 154' constituting a driving source is secured to the supporting plate 152'. The electric motor 154' and the main body portion 4' are drivingly connected via a bevel gear mechanism 56'. A small bevel gear 158' is mounted on the output shaft of the electric motor 154'. A large bevel gear 160' is mounted on the outer circumferential surface of the upper portion 10' of the main body portion 4'. These two gears 158' and 160' are in mesh with each other. Thus, when the electric motor 154' is energized, the small bevel gear 158' revolves around the large bevel gear 160' of the main body portion 4' since the seal member 16' mounted on the main body portion 4' is in contact with the wall surface 12'. As a result, the rotary securing portion 6' is rotated with respect to the main body portion 4'.

In the first embodiment, the cylinder mechanism is provided in the rotary securing portion 6 rotatable with respect to the main body portion 4. If desired, the moving direction of the main body 2 of the device may be changed by omitting the rotary securing portion 6, mounting a plurality of circumferentially spaced cylinder mechanism in the main body portion 6 and selecting the cylinder mechanism to be energized.

Second Embodiment

Figure 5:
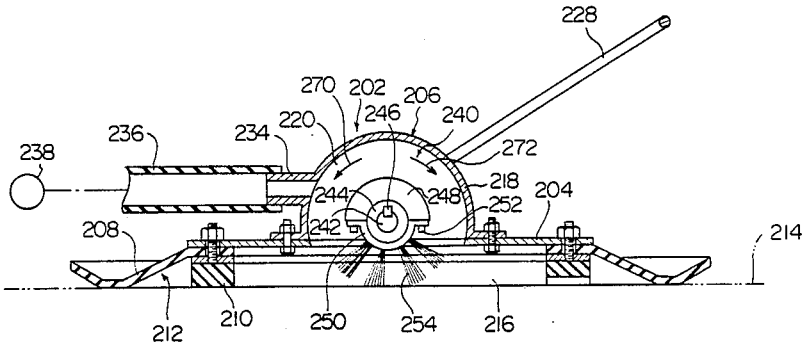
FIG. 5 is a sectional view showing a second embodiment of the device of this invention.
Figure 6:
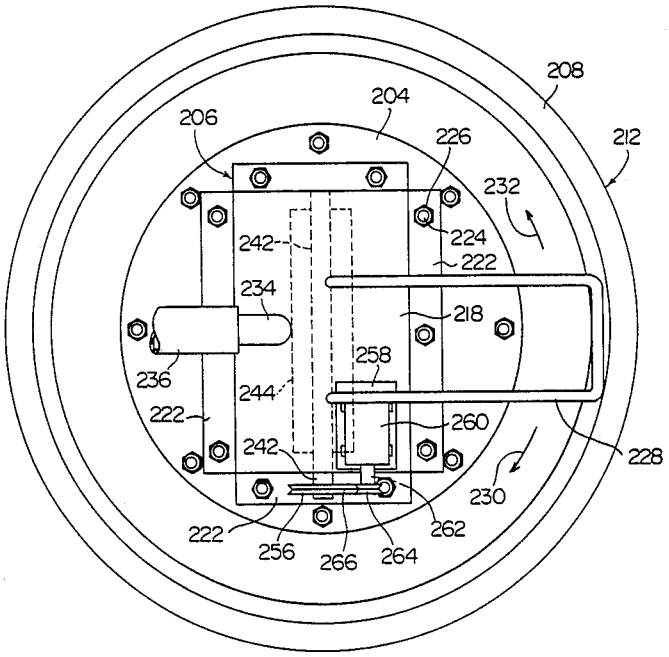
FIG. 6 is a top plan view of the device shown in FIG. 5.

With reference to FIGS. 5 and 6, the second embodiment of the device of this invention will be described. In the second embodiment, the structure of the main body of the device and the vibration generating means are altered.

In FIGS. 5 and 6, the illustrated device is provided with a main body shown generally at 202. The main body 202 includes a disc-like main body portion 204 and a cover portion 206 disposed nearly centrally in the main body portion 204. As in the first embodiment, a seal member 212 consisting of a seal portion 208 and a receiving portion 210 is mounted on the peripheral edge part of the main body portion 204. The seal member 212 cooperates with the main body 202 of the device and a wall surface 214 and define a pressure reduction space 216. The cover portion 206 of the main body 202 has a hollow semi-cylindrical main wall 218 semicircular end walls 220 (FIG. 4 shows only one of them) disposed on both ends of the main wall 218, and flange portions 222 provided at the main wall 218 and the end walls 220 are fixed to the main body portion 204 by means of a plurality of bolts 224 and nuts 226 (see FIG. 5 in particular).

In the second embodiment, an operating handle 228 for switching over the moving direction of the main body 202 is fixed to the main wall 218. By moving the operating handle 228 in the direction shown by an arrow 230 or 232, the moving direction of the main body 202 can be changed to the right or left. A connecting portion 234 is integrally provided in the main wall 218. A rubber hose 236 which communicates with vacuum creating means 238 such as a vacuum pump is connected to the connecting portion 234. Hence, when the vacuum creating means 238 is energized, a fluid such as air in the pressure reduction space 216 is discharged outside through an opening formed in the main body portion 204, the inside of the cover portion 206 and the rubber hose 236.

In the second embodiment, vibration generating means 240 for moving the main body 202 of the device is disposed within the cover portion 206 of the main body 202 of the device. A rotating shaft 242 is mounted rotatably across the pair of end walls 220 of the cover portion 206 via a bearing member (not shown). The intermediate part (the part existing between the pair of end walls 220) of the rotating shaft 242 has mounted thereon a sleeve shaft 244, and the rotating shaft 242 and the sleeve shaft 244 are drivingly connected via a key member 246. A semicircular eccentric weight 248 and a semiarcuate brush holder 250 are secured to the sleeve shaft 244 by positioning the eccentric weight 248 and the brush holder 250 on the outer circumferential surface of the sleeve shaft 244 and clamping them by means of bolts 252. Cricumferentially spaced bristles which may be formed of a synthetic resin such as nylon are implanted in the brush holder 250 over substantially its entire width in the longitudinal direction to form a brush 254. One end portion of the rotating shaft 242 projects outwardly through one end wall, and a pulley 256 is mounted on the projecting end portion. A securing stand 258 is fixed to the outside surface of the main wall 218 of the cover portion 206, and an electric motor 260 constituting a driving source is mounted on the securing stand 258. Preferably, the electric motor 260 can be rotated both in a normal direction and in a reverse direction. A pulley 264 fixed to the output shaft 262 of the electric motor 260 and the above pulley 256 are drivingly connected via a transmission member such as a belt 266 (FIG. 6). When the electric motor rotates in the normal direction (or in the reverse direction), the rotating shaft 242 is rotated in the direction shown by an arrow 270 (or 272) (FIG. 5) via the pulley 264, the belt 266 and the the pulley 256.

With reference mainly to FIG. 5, when the vacuum creating means 238 is energized in the second embodiment, the fluid in the pressure reduction space 216 is discharged outside through the hose 236, and the pressure is reduced in the pressure reduction space 216. As a result, as in the first embodiment, an ambient fluid pressure such as air acts on the main body 202 of the device (the main body portion 204 and the cover portion 206) owing to the difference in fluid pressure between the inside and outside of the pressure reduction space 216, and the main body 202 suction-adheres to the wall surface 214.

When the electric motor 260 (FIG. 6) is rotated in the normal direction (or reverse direction) in the above suction-adhering state, its rotating force is transmitted to the rotating shaft 242 via the pulley 264, the belt 266 and the pulley 256 to rotate the sleeve shaft 244 in the direction of arrow 270 (or 272). As a result, the eccentric weight constituting the vibration generation means 240 is also rotated in the direction of arrow 270 (or 272) as a unit with the sleeve shaft 244. Every time the eccentric weight 248 rotates through one turn, vibration acts on the main body 202 to move it. Specifically, when the eccentric weight 248 moves in a direction away from the wall surface 214 while rotating in the direction of arrow 270 (or 272), its movement generates a lifting force in a direction away from the wall surface 214 on the main body 202. It will be understood from FIG. 5 that when the force in a direction away from the wall surface 214 is exerted on the main body 202, the eccentric weight 248 moves mainly to the left (or to the right) in FIG. 5 about the sleeve shaft 244 as a center. By the movement of the eccentric weight 248, a moving force directed to the left (or the right) along the wall surface 214 acts simultaneously on the main body 202 of the device. Accordingly, as in the first embodiment, the frictional force between the receiving portion 210 of the seal member 212 and the wall surface 214 is weakened by the force in the direction away from the wall surface 214, and the moving force is exerted on the main body 202 by the force directed to the left (or the right) along the wall surface 214. Thus, the device suction-adhering to the wall surface 214 is moved to the left (or right) in FIG. 5 as the eccentric weight 248 rotates in the normal direction (or in the reverse direction).

When the sleeve shaft 244 rotates in the direction shown by arrow 270 (or 272), the tip of the brush 254 as surface-treating means act on the wall surface 214, and the wall surface 214 can be cleaned by the brush 254. The abrasive or cleaning action of the brush 254 may be increased by attaching an abrasive material, etc. to the tip portion of the brush 254.

The devices of the first and second embodiments do not at all require a wheel or an endless track as travelling means because they move along a wall surface by utilizing vibration generated by vibration generating means such as a cylinder mechanism or an eccentric weight. Hence, the devices as a whole can be simplified in structure and reduced in size.

The devices in the first and second embodiments can be used not only in a gas such as atmospheric air, but also in a liquid such as water or sea water.

While the invention has been described with reference to the specific embodiments shown in the drawings, it should be understood that the invention is not limited to these specific embodiments, and various changes and modifications are possible without departing from the scope of the invention described and claimed herein.

For example, the embodiments described hereinabove are directed to the type in which the main body of the device suction-adheres to a wall surface by the ambient fluid pressure acting on the main body owing to the difference in fluid pressure between the inside and outside of the pressure reduction space. This is not limitative. If desired, the invention can equally be applied to the type in which magnetic attracting means is provided in the main body of the device, and the main body of the device is magnetically attracted to the wall surface by the action of the magnetic attracting means.

What is claimed is:

1. A device for moving along a wall surface, said device comprising a main body, means for providing a holding force for holding the device against the wall surface, and vibration generating means mounted on the main body, said vibration generating means being adapted to impart a lifting force in a direction away from a wall surface to reduce the holding force, said vibration generating means also imparting a force in a predetermined direction along the wall surface to the main body by the vibration it generates to move the main body in said predetermined direction along the wall surface, said vibration generating means being provided with a cylinder mechanism including a housing and a piston disposed movably within the housing, said cylinder mechanism being mounted on the main body of the device and being inclined at a predetermined angle to the wall surface, said lifting force extending in a direction away from the wall surface and said force in said predetermined direction along the wall surface being imparted by stretching and contraction of the cylinder mechanism.

2. A device according to claim 1 including means for treating a wall surface.

3. The device of claim 2 wherein said vibration generating means is provided with a cylinder mechanism including a housing and a piston disposed movably within the housing, said cylinder mechanism is mounted on the main body of the device while being inclined at a predetermined angle to the wall surface, and said force in a direction away from the wall surface and said force in said predetermined direction along the wall surface are imparted by the stretching and contraction of the cylinder mechanism.

4. The device of claim 3 wherein the piston of the cylinder mechanism is fixed to part of the main body of the device, and biasing means for biasing the housing of the cylinder mechanism in a direction away from the wall surface is interposed between said part of the main body and the housing of the cylinder mechanism.

5. The device of claim 2 wherein the main body of the device is provided with a main body portion and a rotary securing portion mounted rotatably on the main body portion, said vibration generating means is secured to the rotary securing portion, and the moving direction of the main body of the device is switched over by rotating the rotary securing portion relative to the main body portion.

6. The device of claim 5 wherein the rotary securing portion has provided therein an operating handle for rotating the rotary securing portion relative to the main body portion.

7. The device of claim 5 wherein a driving source for rotating the main body portion and the rotary securing portion is provided in one of the main body portion and the rotary securing portion.

8. A device for moving along a wall surface, said device comprising a main body, a seal member mounted in the main body, a pressure reduction space defined by said seal in cooperation with a wall surface and the main body, vacuum creating means for discharging a fluid from the pressure reduction space, and vibration generating means mounted on the main body, wherein the vacuum creating means reduces the pressure in the pressure reduction space by discharging a fluid therein to a location outside the pressure reduction space, the main body suction adheres to the wall surface by a suction-adhering force of fluid pressure acting on the main body owing to the difference in fluid pressure inside and outside of the pressure reduction space, and the vibration generating means generates vibrations that impart a lifting force to the main body in a direction away from the wall surface to reduce the suction-adhering force, and the vibration generating means also imparts a moving force to the main body in a direction along the wall surface, thereby moving the main body along the wall surface.

9. The device of claim 8 wherein said vibration generating means is provided with an eccentric weight secured to a rotating shaft mounted rotatably on the main body of the device, and said force in a direction away from the wall surface and said force in the predetermined direction along the wall surface are imparted by the rotating of the eccentric weight.

10. The device of claim 9 wherein surface treating means for acting on the wall surface and treating it is provided in at least one of the rotating shaft and the eccentric weight.

11. The device of claim 8 wherein the seal member has one end and another end, said seal having a main portion extending from its one end connected to the main body of the device outwardly toward a contact portion to contact the wall surface in a direction approaching the wall surface, and an extension extending outwardly from the contacting portion toward its other end in a direction away from the wall surface.

12. The device of claim 8 wherein the seal member is provided with a receiving portion for receiving the main body of the device and a channel is formed at that part of the receiving portion which is to make contact with the wall surface.

13. The device of claim 8 wherein magnetically attracting means which magnetically adheres to the wall surface is provided in the main body of the device.

14. The device of claim 8 wherein treating means for treating the wall surface is disposed in the main body of the device.

15. The device of claim 8 wherein a plurality of said vibration generating means are provided in spaced-apart relationship circumferentially in the main body and the moving direction of the main body of the device is changed by selecting the vibration generating means to be energized.

16. A device according to claim 8 including means for treating a wall surface.

17. A device for moving along a wall surface, said device comprising a main body, means for holding the device against a wall, and vibration generating means mounted on the main body, said vibration generating means being adapted to impart to the main body a lifting force in a direction away from a wall surface and a moving force in a predetermined direction along the wall surface by the vibration it generates, said lifting force reducing said holding force, and said moving force moving the main body in said predetermined direction along the wall surface, the main body of the device being provided with a main body portion and a rotary securing portion mounted rotatably on the main body portion, said vibration generating means being secured to the rotary securing portion, and the moving direction of the main body of the device being changeable by rotating the rotary securing portion relative to the main body portion.

18. A device according to claim 17 including means for treating a wall surface.

* * * * *